US011713883B2

(12) United States Patent
Barber

(10) Patent No.: US 11,713,883 B2
(45) Date of Patent: Aug. 1, 2023

(54) SAFELY BARRIER HEAT EXCHANGER

(71) Applicant: Nicholas Barber, Vancouver (CA)

(72) Inventor: Nicholas Barber, Vancouver (CA)

( * ) Notice: Subject to any disclaimer, the term of this patent is extended or adjusted under 35 U.S.C. 154(b) by 395 days.

(21) Appl. No.: 17/274,402

(22) PCT Filed: Sep. 6, 2019

(86) PCT No.: PCT/CA2019/000127
§ 371 (c)(1),
(2) Date: Mar. 8, 2021

(87) PCT Pub. No.: WO2020/047648
PCT Pub. Date: Mar. 12, 2020

(65) Prior Publication Data

US 2021/0270462 A1 Sep. 2, 2021

(30) Foreign Application Priority Data

Sep. 6, 2018 (CA) ..... CA 3016944

(51) Int. Cl.
*F24B 1/192* (2006.01)
*F24B 1/188* (2006.01)

(52) U.S. Cl.
CPC ..... *F24B 1/192* (2013.01); *F24B 1/188* (2013.01)

(58) Field of Classification Search
CPC ..... F24B 1/192; F24B 1/188
See application file for complete search history.

(56) References Cited

U.S. PATENT DOCUMENTS 4,129,114 A * 12/1978 Hiser ..... F24B 1/18 126/509
4,291,670 A * 9/1981 Hyatt ..... F24B 1/1802 126/525
4,520,791 A * 6/1985 Chamberlain ..... F24B 7/025 126/518
5,009,219 A * 4/1991 Liet ..... F24B 1/1902 126/525
5,542,407 A * 8/1996 Hawkinson ..... F24C 3/006 126/193

(Continued)

FOREIGN PATENT DOCUMENTS

EP 2236940 A1 10/2010

OTHER PUBLICATIONS

International Search Report issued in PCT/CA2019/000127 dated Nov. 13, 2019 (3 pages).

(Continued)

*Primary Examiner* — David J Laux
(74) *Attorney, Agent, or Firm* — Baumgartner Patent Law; Marc Baumgartner

(57) ABSTRACT

A safety barrier heat exchanger for a heating appliance such as a fireplace or furnace is provided. The safety barrier heat exchanger includes a housing configured for attachment across the viewable opening of a fireplace or a barrier window of a furnace, and a plurality of optically transparent, semi-transparent or translucent safety barriers secured within the housing in spaced apart relationship to define a tortuous or serpentine passageway through which a forced bulk flow of ambient air is passed across a viewable opening or barrier window more than one time. Also provided are fireplace systems comprising the safety barrier heat exchanger.

12 Claims, 8 Drawing Sheets

(56) References Cited

U.S. PATENT DOCUMENTS

| | | | | |
|---|---|---|---|---|
| 6,904,904 | B2 * | 6/2005 | Walther | F24C 15/04 126/200 |
| 2017/0159940 | A1 * | 6/2017 | Little | F24B 1/189 |
| 2017/0205072 | A1 * | 7/2017 | Little | F24B 1/1885 |
| 2018/0245793 | A1 * | 8/2018 | Schroeter | F24B 1/1885 |

OTHER PUBLICATIONS

Written Opinion issued in PCT/CA2019/000127 dated Nov. 13, 2019 (4 pages).

* cited by examiner 312
314
382
390
310
346
348
300
344
332
380
308
304
344
322
302
306
303
384
316
358

SAFELY BARRIER HEAT EXCHANGER

CROSS-REFERENCE TO RELATED APPLICATIONS

The present invention is filed under 35 U.S.C. § 371 as the U.S. National Phase of International Application No. PCT/CA2019/000127, filed Sep. 6, 2019, which designated the U.S. and claims the benefit of Canadian Patent Application No. 3,016,944, filed on Sep. 6, 2018, each of which is hereby incorporated in its entirety including all tables, figures, and claims.

TECHNICAL FIELD

In embodiments of the presently disclosed subject matter, there is provided a safety barrier heat exchanger for a heating appliance such as a fireplace or furnace.

BACKGROUND

As is well known in the art, fireplaces and furnaces for residential and commercial applications come in a wide variety of different configurations. A fireplace generally comprises a firebox defining an interior space in which a combustible material such as wood or gas is burned to produce a flame, and at least one viewable opening through which the flame may be viewed. The viewable opening is preferably configured so as to optimize the visibility and aesthetic effect of the flame feature during operation of the fireplace, and typically extends laterally across at least a portion of the front of the firebox. Fireplaces with two-sided (e.g. front and rear), three-sided and four-sided viewable openings, as well as ellipsoidal and other curved viewable openings are also known.

Most modern fireplaces are constructed as a factory-built insert in which the firebox is surrounded by a refractory chamber that circulates room air around the hot firebox and back into the room during operation of the fireplace (via convection and/or by forced air), and in which the viewable opening may be enclosed and sealed off by a panel of heat resistant safety glass to create a combustion chamber in which the combustible fuel may more efficiently be burned. The enclosed combustion chamber also retains toxic combustion fumes and embers within the fireplace, and prevents direct contact with the flame. Similarly, in furnace applications, a barrier window may be provided in the combustion chamber or plenum in order to enable viewing of the interior thereof during operation. Combustion air for the flame may be drawn by convection or forced into the combustion chamber from the room or from outside of the dwelling through one or more ducts, and heated exhaust gases exit the firebox through a chimney or exit flue.

During operation of the fireplace, and for some time thereafter, the glass panel enclosing the viewable opening may become hot enough to cause injury if touched, and many jurisdictions have accordingly established safety regulations requiring the use of a protective barrier over the glass panel if the temperature of the panel may exceed a certain maximum value (e.g. 77° C.) during operation. Regulations also exist in some jurisdictions to limit the maximum continuous temperature of any warmed return air that is supplied to the room from the refractory chamber (e.g. 57° C.).

A variety of wire mesh safety barrier designs have been devised in order to meet the regulatory "safe touch" requirements, and to generally enhance safety. However, wire mesh barriers tend to impede visibility of the flame feature within an operating fireplace, and can impinge on the clean, uncluttered aesthetic often desired by consumers. For example, Canadian patent no. 2,459,747 to Korzack, et al. provides a fireplace in which the opening of the firebox is enclosed by a flat glass window, and in which a mesh screen constructed of woven wire is situated by a frame at a spaced apart distance on the side of the window that is opposite the firebox. The woven wire mesh of the screen generally cools more easily than the safety glass used for the window because it is further from the heat source and shielded by the window, and because of its porous design, which allows for more efficient radiation of heat from the mesh to the ambient air. The mesh screen thus provides a relatively cool protective barrier in front of the glass window. In preferred embodiments, the mesh is painted black for aesthetic purposes and in order to allow the flame in the fireplace to be somewhat more easily viewed.

Efforts to address the regulatory "safe touch" requirements without impairing visibility of the fire featured within a fireplace have generally focused on the provision of barrier structures in which one or more additional panes of glass are held in spaced apart relationship from the pane of glass that is enclosing the viewable opening to create the combustion chamber. A stream of air is drawn by natural convection or forced through the interstitial gap(s) between the glass panes to cool and maintain at least the outermost pane below a selected maximum temperature during operation of the fireplace, and the outermost pane thus serves as a transparent safety barrier.

By way of example, U.S. patent publication no. 2015/0253037 to Rumens, et al. describes a modular, linear gas burning fireplace system that includes a combustion air flow passage that maintains a relatively low exterior temperature of the assembly, thereby allowing combustible and non-combustible building materials to be installed against or immediately adjacent to the top and base portions of the modular units of the assembly. A firebox module is defined between a base portion and a spaced apart top portion, and between a pair of spaced apart interior glass panels. Exterior glass panels are spaced outwardly apart from each of the interior glass panels to define an air gap or passageway, such that the exterior glass panels are isolated from the firebox and not directly exposed to the flames in the firebox and its associated heat during operation. The height of the firebox and associated viewing area (i.e. the firebox viewable opening) is determined by the height of the corresponding interior and exterior glass panels. Fresh combustion air is forced downwardly through a combustion air passageway that is defined by the gap between the interior and exterior glass panels, thereby carrying heat away from the exterior glass panels. The partially heated combustion air is then channeled into the firebox past the gas burners, where the resulting combustion results in hot exhaust gases that flow upwardly through the firebox and thence into an exhaust passageway or flue.

U.S. patent publication no. 2017/0159940 to Little, et al. describes a fireplace system that may be configured to provide for natural convection cooling of a glass safety barrier during operation of the fireplace without a need for forced convection air management. The fireplace system comprises a firebox with a firebox opening, a first (i.e. inner) glass safety barrier disposed in front of the firebox opening, a second (i.e. outer) glass safety barrier disposed in front of the first glass safety barrier and separated by a selected interbarrier offset dimension to define an interbarrier space between the barriers. The fireplace system may also comprise one or more additional safety barriers, such as a third glass safety barrier, disposed within the interbarrier space between the first safety barrier and the second safety barrier. Whether or not an additional safety barrier is present, the interbarrier space is in fluid communication with ambient air through an interbarrier space inlet that is located beneath the lower edge of the second (i.e. outer) safety barrier, and an interbarrier space outlet located near an upper edge of interbarrier space. The fireplace system may optionally further comprise a firebox top heat exchanger in fluid communication with the interbarrier space outlet. During operation of the fireplace system, thermal energy is transferred from the firebox to a first portion of the convection space air volume, which decreases the air density of the first portion. The resulting decrease in air density (and corresponding increase in air buoyancy) of the first portion generates a natural convection bulk air flow upwards through the interbarrier space, which in turn draws in fresh ambient air through the interbarrier space inlet. Ambient intake air entering the interbarrier space through the interbarrier space inlet may receive thermal energy from the first safety barrier and/or the firebox and opening (such as by conductive and radiant thermal energy transfer), and may also receive thermal energy from the second safety barrier and/or serve to cool and/or thermally insulate the second safety barrier, thereby maintaining the second safety barrier at a temperature that is below a selected maximum operating temperature.

High heat transfer efficiency and high heat output for space heating are among the more desirable attributes in modern fireplace systems, and many systems primarily rely on a firebox top heat exchanger for this purpose. Firebox top heat exchangers are well known in the art, and generally comprise a series of passageways situated within the refractory chamber or exit flue above the firebox through which room air is circulated (by natural convection or by a forced air circulating fan or blower) to recover a portion of the combustion heat from the hot exhaust gases, which would otherwise simply be sent up the chimney or flue. As described in U.S. 2017/0159940 to Little, et al., a safety barrier system may assist with the achievement of these objectives by supplying at least partially warmed ambient room air back into the room and/or into a firebox top heat exchanger. However, the capacity of prior known multiple glass pane safety barrier systems themselves (whether reliant upon natural convection or on forced air) to harvest radiant and conductive energy from the flame and the firebox for space heating purposes is limited because the barrier and interstitial gap structure in all such prior known barrier systems permits the bulk flow of ambient air to pass across the viewable opening only one time. In other words, the heat transfer efficiency of prior known safety barrier systems for space heating purposes is limited because all of the thermal convective energy acquisition by the bulk flow of ambient room air occurs during a single pass across the radiant and conductive heat source.

Some gains in heat transfer efficiency may be available in prior known barrier systems by slowing down the velocity of the bulk flow (so as to extend the duration of time that any given portion of the bulk flow of ambient air is exposed to the radiant and conductive heat source), but such gains are relatively modest because slowing the bulk flow velocity results in a corresponding increase in heat transfer to the outermost barrier pane, eventually resulting in loss of the ability to maintain the outermost pane below the selected maximum temperature. It would accordingly be desirable to provide a substantially transparent safety barrier that not only permits a relatively unobstructed view of the flame feature within the firebox of a fireplace system while maintaining an outermost barrier pane below a selected maximum temperature during operation of the fireplace, but that also simultaneously harvests fireplace radiant energy with increased efficiency for space heating purposes over a wide range of fireplace operating temperatures.

SUMMARY

In accordance with a broad aspect of the present disclosure, a safety barrier heat exchanger for a heating appliance such as a fireplace or furnace defines a tortuous or serpentine passageway through which a forced bulk flow of ambient air is passed across a viewable opening more than one time. The serpentine configuration of the passageway effectively lengthens the flow path of the ambient room air through the safety barrier heat exchanger, and traversing the viewable opening heat source multiple times effectively creates an additive or stepwise accumulation of heat in the bulk air flow (i.e. by conversion of radiant and conductive thermal energy emanating from the viewable opening into convective thermal energy in the bulk air flow), such that the bulk air flow becomes incrementally hotter with each traverse or pass across the viewable opening. Each successive arm of the serpentine passageway is situated closer to the viewable opening heat source than the preceding arm so that, in use, upon completion of the initial traverse across the viewable opening (i.e. within the initial, outermost arm of the serpentine passageway, adjacent the outermost panel or portion of the safety barrier heat exchanger) the bulk air flow of ambient air has not yet acquired sufficient thermal energy to cause the outermost panel or portion to exceed a maximum suitable safety barrier temperature. However, after the bulk air flow has completed a plurality of additional traverses across the heat source within the plurality of successive arms of the serpentine passageway, the bulk air flow will have incrementally accumulated sufficient thermal energy for high output space heating purposes.

In exemplary embodiments of the presently described subject matter, a fireplace system comprising a safety barrier heat exchanger is provided. The fireplace system includes a firebox defining an interior space in which a combustible material is burned to produce a flame; at least one viewable opening through which the flame may be viewed; a glass or optically transparent, semi-transparent or translucent panel disposed across the viewable opening which, in combination with the firebox, forms a combustion chamber; at least one opening in a lower portion of the firebox for permitting combustion air to pass into the combustion chamber; and at least one opening in an upper portion of the firebox for exhausting combustion gases from the combustion chamber. A safety barrier heat exchanger is disposed across the glass panel and viewable opening of the firebox. The safety barrier heat exchanger comprises: a housing affixed to the firebox, the housing comprising top, bottom and two opposite side panels; a first optically transparent, semi-transparent or translucent safety barrier secured within the housing by upper, lower and two opposing side first safety barrier brackets or mounting rails, wherein the first safety barrier is separated from the glass panel of the firebox by an offset dimension to define a first interstitial space between the glass panel and the first safety barrier; a second optically transparent, semi-transparent or translucent safety barrier secured within the housing by upper, lower and two opposing side second safety barrier brackets or mounting rails, wherein the first safety barrier and the second safety barrier are separated by an offset dimension and define a second interstitial space between the first safety barrier and the second safety barrier; at least one ambient air inlet opening at a first end of the housing in fluid communication with the second interstitial space; at least one exit opening at a first end of the housing in fluid communication with the first interstitial space; at least one opening at a second end of the housing connecting the first and second interstitial spaces in fluid communication to define a serpentine safety barrier heat exchanger passageway; and at least one forced air circulating fan or blower secured within the housing and operatively configured to force air through the serpentine safety bather heat exchanger passageway from the at least one inlet opening to the at least one exit opening. Preferably, the at least one fan or blower is situated within the housing at a location calculated or intended to mitigate fan noise, such as within the first interstitial space adjacent the opening at a second end of the housing connecting the first and second interstitial spaces in fluid communication. In some embodiments, the housing may be configured to be modular and removable and/or adjustable with respect to the firebox.

In the exemplary embodiments described above, two interstitial spaces (i.e. the first interstitial space between the glass panel of the firebox and the first safety barrier, and the second interstitial space between the first safety barrier and the second safety barrier) are combined (via the opening at the second end of the housing) to create a serpentine safety bather heat exchanger passageway comprising two "arms" through which the ambient air is successively driven across the viewable opening two times by the forced air circulating fan or blower from the inlet opening located at a first end of the housing and through to the exit opening that is also located at a first end of the housing. Alternate exemplary embodiments in which the both the ambient air inlet and exit openings are located at the same end of the housing, but in which the serpentine safety barrier heat exchanger passageway comprises four, six, eight, or any even number of arms are also contemplated and within the scope of the present disclosure. In all such embodiments, one or more additional pairs of optically transparent, semi-transparent or translucent safety barrier panels are secured within the housing by corresponding brackets or mounting rails, and connected in fluid communication by corresponding openings located at alternating ends of the housing to define an extended serpentine safety barrier heat exchanger passageway therethrough. By way of example, an embodiment in which the extended serpentine safety barrier heat exchanger passageway comprises four interstitial spaces may comprise first, second, third and fourth optically transparent, semi-transparent or translucent safety barriers, each secured within the housing at an offset dimension (so as to define the first, second, third and fourth interstitial spaces); at least one ambient air inlet opening at a first end of the housing in fluid communication with the fourth interstitial space; at least one exit opening at a first end of the housing in fluid communication with the first interstitial space; at least one opening at a second end of the housing connecting the first and second interstitial spaces in fluid communication; at least one opening at the first end of the housing connecting the third and fourth interstitial spaces in fluid communication; and at least one forced air circulating fan or blower secured within the housing and operatively configured to force ambient air through the extended serpentine safety barrier heat exchanger passageway from the at least one inlet opening to the at least one exit opening.

In other exemplary embodiments of the presently described subject matter, the ambient air inlet opening and the exit opening may be located at opposite ends of the housing, and the serpentine safety barrier heat exchanger passageway may comprise three, five, seven, or any greater odd number of arms. In one such embodiment, a fireplace system comprising a safety barrier heat exchanger includes a firebox defining an interior space in which a combustible material is burned to produce a flame; at least one viewable opening through which the flame may be viewed; a glass or optically transparent, semi-transparent or translucent panel disposed across the viewable opening which, in combination with the firebox, forms a combustion chamber; at least one opening in a lower portion of the firebox for permitting combustion air to pass into the combustion chamber; and at least one opening in an upper portion of the firebox for exhausting combustion gases from the combustion chamber. A safety barrier heat exchanger is disposed across the glass panel and viewable opening of the firebox. The safety barrier heat exchanger comprises: a housing affixed to the firebox, the housing comprising top, bottom and two opposite side panels; a first optically transparent, semi-transparent or translucent safety barrier secured within the housing by upper, lower and two opposing side first safety barrier brackets or mounting rails, wherein the first safety barrier is separated from the glass panel of the firebox by an offset dimension to define a first interstitial space between the glass panel and the first safety barrier; a second optically transparent, semi-transparent or translucent safety barrier secured within the housing by upper, lower and two opposing side second safety barrier brackets or mounting rails, wherein the first safety barrier and the second safety barrier are separated by an offset dimension and define a second interstitial space between the first safety barrier and the second safety barrier; a third optically transparent, semi-transparent or translucent safety barrier secured within the housing by upper, lower and two opposing side third safety barrier brackets or mounting rails, wherein the second safety barrier and the third safety barrier are separated by an offset dimension and define a third interstitial space between the second safety barrier and the third safety barrier; at least one inlet opening at a second end of the housing in fluid communication with the third interstitial space; at least one exit opening at a first end of the housing in fluid communication with the first interstitial space; at least one opening at a second end of the housing connecting the first and second interstitial spaces in fluid communication, and at least one opening at a first end of the housing connecting the second and third interstitial spaces in fluid communication to define a serpentine safety barrier heat exchanger passageway; and at least one forced air circulating fan or blower secured within the housing and operatively configured to force air through the serpentine safety barrier heat exchanger passageway from the at least one inlet opening to the at least one exit opening. Preferably, the at least one fan or blower is situated within the housing at a location calculated or intended to mitigate fan noise, such as within the first interstitial space adjacent the opening at a second end of the housing connecting the first and second interstitial spaces in fluid communication. In some embodiments, the housing may be configured to be modular and removable and/or adjustable with respect to the firebox.

As described above in relation to embodiments wherein the serpentine safety barrier heat exchanger passageway comprises an even number of arms, additional exemplary embodiments of a safety barrier heat exchanger in which the ambient air inlet opening and the exit opening are located at opposite ends of the housing and the serpentine safety barrier heat exchanger passageway comprises any odd number of arms greater than three are also contemplated and within the scope of the present disclosure. In all such embodiments, one or more additional pairs of optically transparent, semi-transparent or translucent safety barrier panels are secured within the housing by corresponding brackets or mounting rails, and connected in fluid communication by corresponding openings located at alternating ends of the housing to define an extended serpentine safety barrier heat exchanger passageway therethrough.

In further exemplary embodiments of the presently described subject matter, a safety barrier heat exchanger is provided for a fireplace system that comprises a firebox with viewable opening, and a glass or optically transparent, semi-transparent or translucent panel disposed across the viewable opening which, in combination with the firebox, forms a combustion chamber. The safety barrier heat exchanger is configured for attachment across the glass panel and viewable opening of the firebox, and comprises: a housing affixed to the firebox, the housing comprising top, bottom and two opposite side panels; a first optically transparent, semi-transparent or translucent safety barrier secured within the housing by upper, lower and two opposing side first safety barrier brackets or mounting rails, wherein the first safety barrier is separated from the glass panel of the firebox by an offset dimension to define a first interstitial space between the glass panel and the first safety barrier; a second optically transparent, semi-transparent or translucent safety barrier secured within the housing by upper, lower and two opposing side second safety barrier brackets or mounting rails, wherein the first safety barrier and the second safety barrier are separated by an offset dimension and define a second interstitial space between the first safety barrier and the second safety barrier; at least one ambient air inlet opening at a first end of the housing in fluid communication with the second interstitial space; at least one exit opening at a first end of the housing in fluid communication with the first interstitial space; at least one opening at a second end of the housing connecting the first and second interstitial spaces in fluid communication to define a serpentine safety barrier heat exchanger passageway; and at least one forced air circulating fan or blower secured within the housing and operatively configured to force air through the serpentine safety barrier heat exchanger passageway from the at least one inlet opening to the at least one exit opening. Preferably, the at least one fan or blower is situated within the housing at a location calculated or intended to mitigate fan noise, such as within the first interstitial space adjacent the opening at a second end of the housing connecting the first and second interstitial spaces in fluid communication. In some embodiments, the housing may be configured to be modular and removable and/or adjustable with respect to the firebox.

In further exemplary embodiments of the presently described subject matter, a safety barrier heat exchanger is provided for a fireplace system that comprises a firebox with viewable opening, but without a glass panel disposed across the viewable opening to form a combustion chamber. In such embodiments, the safety barrier heat exchanger is configured for attachment across the viewable opening of the firebox, and comprises: a housing hermetically affixed to the firebox, the housing comprising top, bottom and two opposite side panels; an optically transparent, semi-transparent or translucent combustion chamber barrier hermetically secured within the housing by upper, lower and two opposing side combustion barrier brackets or mounting rails, and disposed across the viewable opening to form a sealed firebox combustion chamber; a first optically transparent, semi-transparent or translucent safety barrier secured within the housing by upper, lower and two opposing side first safety barrier brackets or mounting rails, wherein the first safety barrier is separated from the combustion chamber barrier by an offset dimension to define a first interstitial space between the combustion chamber barrier the first safety barrier; a second optically transparent, semi-transparent or translucent safety barrier secured within the housing by upper, lower and two opposing side second safety barrier brackets or mounting rails, wherein the first safety barrier and the second safety barrier are separated by an offset dimension and define a second interstitial space between the first safety barrier and the second safety barrier; at least one ambient air inlet opening at a first end of the housing in fluid communication with the second interstitial space; at least one exit opening at a first end of the housing in fluid communication with the first interstitial space; at least one opening at a second end of the housing connecting the first and second interstitial spaces in fluid communication to define a serpentine safety barrier heat exchanger passageway; and at least one forced air circulating fan or blower secured within the housing and operatively configured to force air through the serpentine safety barrier heat exchanger passageway from the at least one inlet opening to the at least one exit opening. Preferably, the at least one fan or blower is situated within the housing at a location calculated or intended to mitigate fan noise, such as within the first interstitial space adjacent the opening at a second end of the housing connecting the first and second interstitial spaces in fluid communication. In some embodiments, the housing may be configured to be modular and removable and/or adjustable with respect to the firebox.

Although the direction of bulk air flow through the arms of the serpentine safety barrier heat exchanger passageway (or extended serpentine safety barrier heat exchanger passageway) may be from side to side, up and down, or any combination thereof, in preferred embodiments the first end of the housing and the at least one exit opening are located at the top of the safety barrier heat exchanger, and the direction of forced bulk airflow within the first interstitial space is upwards. In further exemplary embodiments, a fireplace system may include a refractory chamber and, optionally, also a firebox top heat exchanger. In one such embodiment, the fireplace system includes a firebox defining an interior space in which a combustible material is burned to produce a flame; at least one viewable opening through which the flame may be viewed; a glass or optically transparent, semi-transparent or translucent panel disposed across the viewable opening which, in combination with the firebox, forms a combustion chamber; at least one opening in a lower portion of the firebox for permitting combustion air to pass into the combustion chamber; at least one opening in an upper portion of the firebox for exhausting combustion gases from the combustion chamber; a refractory chamber surrounding the firebox except across the at least one viewable opening, the refractory chamber comprising at least one refractory chamber ambient air inlet and one refractory chamber ambient air outlet; and a firebox top heat exchanger disposed above the firebox within the refractory chamber. A safety barrier heat exchanger is disposed across the glass panel and viewable opening of the firebox. The safety barrier heat exchanger comprises: a housing affixed to the firebox, the housing comprising top, bottom and two opposite side panels; a first optically transparent, semi-transparent or translucent safety barrier secured within the housing by upper, lower and two opposing side first safety barrier brackets or mounting rails, wherein the first safety barrier is separated from the glass panel of the firebox by an offset dimension to define a first interstitial space between the glass panel and the first safety barrier; a second optically transparent, semi-transparent or translucent safety barrier secured within the housing by upper, lower and two opposing side second safety barrier brackets or mounting rails, wherein the first safety barrier and the second safety barrier are separated by an offset dimension and define a second interstitial space between the first safety barrier and the second safety barrier; at least one ambient air inlet opening at a first end of the housing in fluid communication with the second interstitial space; at least one exit opening at a first end of the housing connecting the first interstitial space and the at least one refractory chamber air inlet in fluid communication; at least one opening at a second end of the housing connecting the first and second interstitial spaces in fluid communication to define a serpentine safety barrier heat exchanger passageway; and at least one forced air circulating fan or blower secured within the housing and operatively configured to force air through the serpentine safety barrier heat exchanger passageway from the at least one inlet opening to the at least one exit opening. Preferably, the at least one fan or blower is situated within the housing at a location calculated or intended to mitigate fan noise, such as within the first interstitial space adjacent the opening at a second end of the housing connecting the first and second interstitial spaces in fluid communication. In some embodiments, the housing may be configured to be modular and removable and/or adjustable with respect to the firebox.

In yet further exemplary embodiments of the presently described subject matter, a safety barrier heat exchanger is provided for a furnace system that comprises a combustion chamber or plenum barrier window to enable viewing of the interior thereof during operation. The safety barrier heat exchanger is configured for attachment across the barrier window of the furnace, and comprises: a housing affixed to the furnace, the housing comprising top, bottom and two opposite side panels; a first optically transparent, semi-transparent or translucent safety barrier secured within the housing by upper, lower and two opposing side first safety barrier brackets or mounting rails, wherein the first safety barrier is separated from the barrier window of the furnace by an offset dimension to define a first interstitial space between the barrier window and the first safety barrier; a second optically transparent, semi-transparent or translucent safety barrier secured within the housing by upper, lower and two opposing side second safety barrier brackets or mounting rails, wherein the first safety barrier and the second safety barrier are separated by an offset dimension and define a second interstitial space between the first safety barrier and the second safety barrier; at least one ambient air inlet opening at a first end of the housing in fluid communication with the second interstitial space; at least one exit opening at a first end of the housing in fluid communication with the first interstitial space; at least one opening at a second end of the housing connecting the first and second interstitial spaces in fluid communication to define a serpentine safety barrier heat exchanger passageway; and at least one forced air circulating fan or blower secured within the housing and operatively configured to force air through the serpentine safety barrier heat exchanger passageway from the at least one inlet opening to the at least one exit opening. Preferably, the at least one fan or blower is situated within the housing at a location calculated or intended to mitigate fan noise, such as within the first interstitial space adjacent the opening at a second end of the housing connecting the first and second interstitial spaces in fluid communication. In some embodiments, the housing may be configured to be modular and removable and/or adjustable with respect to the firebox.

BRIEF DESCRIPTION OF THE DRAWINGS

For a fuller understanding of the nature and advantages of the disclosed subject matter, as well as the preferred modes of use thereof, reference should be made to the following detailed description, read in conjunction with the accompanying drawings. In the drawings, like reference numerals designate like or similar steps or parts.

DETAILED DESCRIPTION OF SPECIFIC EMBODIMENTS

The following description of preferred embodiments is merely exemplary in nature and is in no way intended to limit the invention, its application, or uses. The safety barrier heat exchanger of the present invention may take form in a number of different embodiments depending upon the particular requirements of the use.

Figure 1:
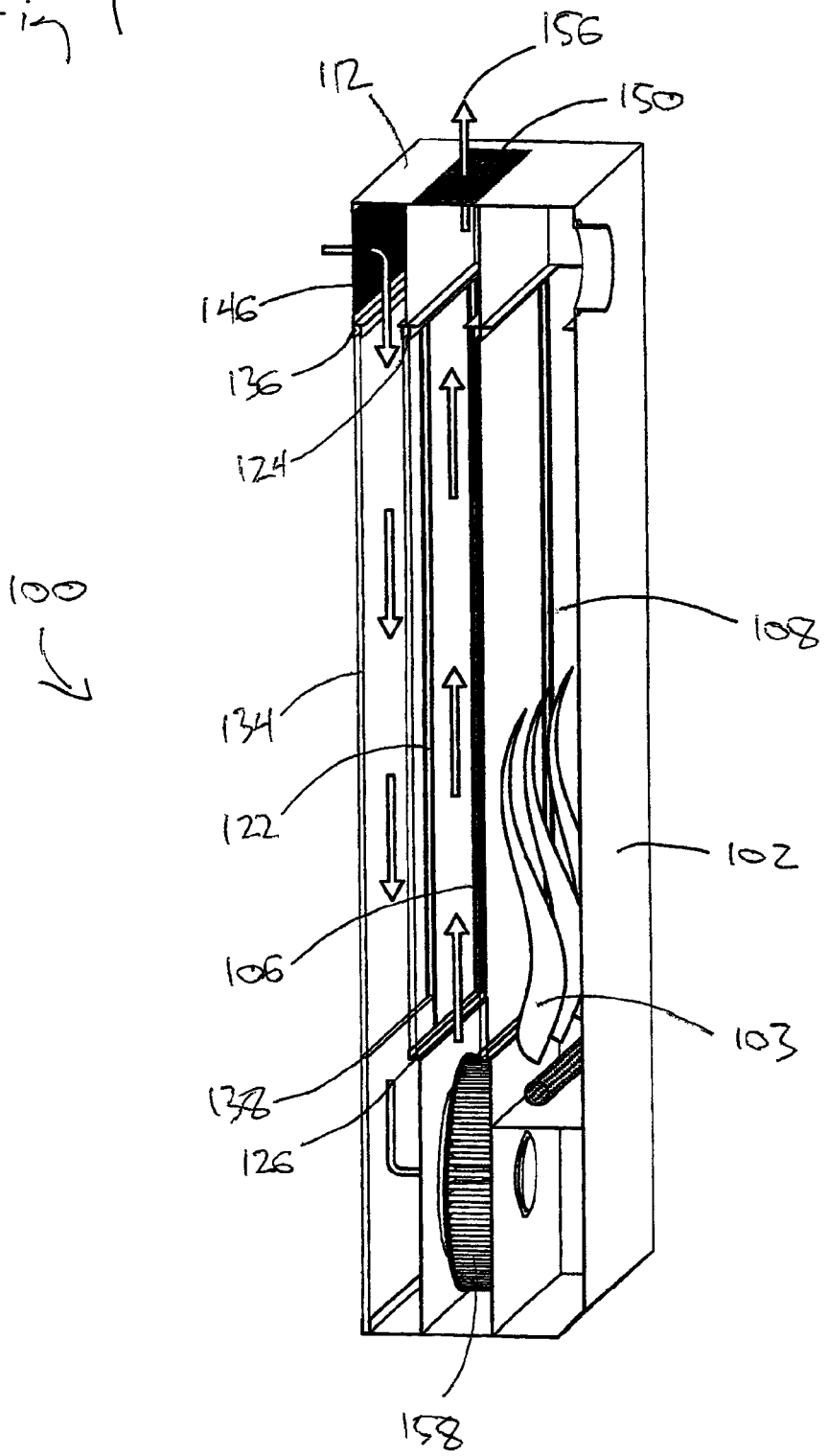
FIG. 1 is a schematic cutaway perspective view of a fireplace comprising a 3-panel fireplace safety barrier heat exchanger in accordance with one embodiment of the presently described subject matter.
Figure 2:
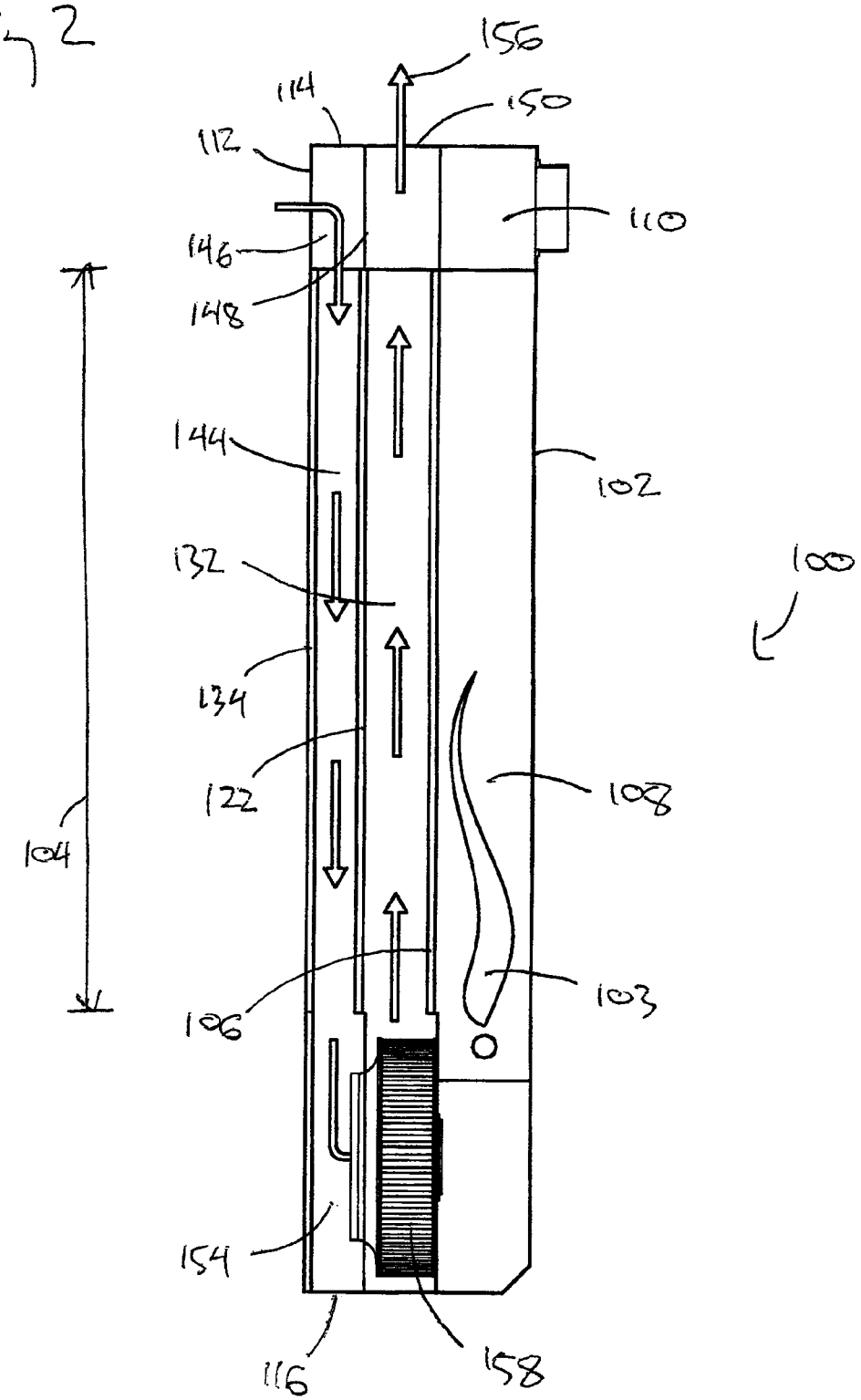
FIG. 2 is a vertical cross sectional side view of the fireplace of FIG. 1.
Figure 3:
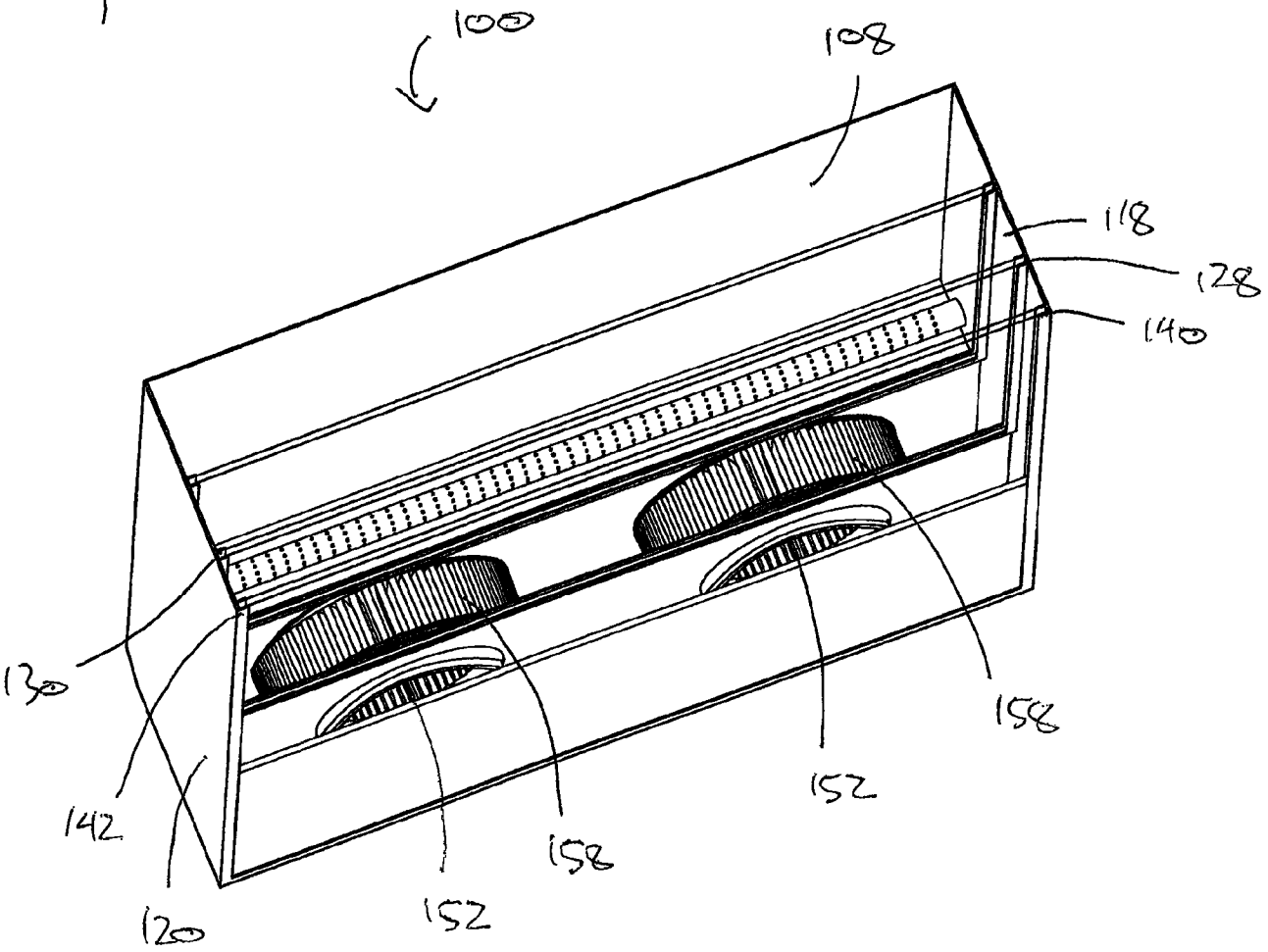
FIG. 3 is a horizontal cross sectional side view of the fireplace of FIG. 1.

With reference to FIGS. 1-3, there is illustrated a fireplace with fireplace safety barrier heat exchanger 100 in accordance with one embodiment of the presently described subject matter. The illustrated fireplace 100 is a gas burning fireplace connected to a fuel source (not shown), and comprises a firebox 102 and further defines a viewable opening 104 that provides visibility to the interior of the firebox 102 and a fire feature and/or flame 103 when fireplace 100 is in operation. In various embodiments, a fire feature 103 can comprise a burner, fire rock or fire glass, ceramic gas fireplace logs, and the like. Firebox 102 and viewable opening 104 can have any of a number of configurations in accordance with various embodiments. In the illustrated embodiment, viewable opening 102 is shown on a single side of firebox 102 for simplicity, but as is well known in the art, firebox 102 may have viewable openings on multiple sides in any of a variety of viewable opening configurations that are known in the art.

In the embodiment of FIGS. 1-3, the fireplace system with safety barrier heat exchanger 100 generally comprises a firebox 102 having a viewable opening 104; a glass panel 106 disposed across the viewable opening which, in combination with the firebox, forms a combustion chamber 108; at least one opening (not shown) in a lower portion of the firebox 102 for permitting combustion air to pass into the combustion chamber 108, and at least one opening 110 in an upper portion of the firebox 102 for exhausting combustion gases from the combustion chamber 108; and a safety barrier heat exchanger disposed across the glass panel 106 and viewable opening 104 of the firebox 102, the safety barrier heat exchanger comprising: a housing affixed to the firebox, the housing 112 comprising top 114, bottom 116 and two opposite side panels 118, 120 (FIG. 3); a first transparent safety barrier 122 secured within the housing 112 by upper 124, lower 126 and two opposing side first safety barrier brackets 128, 130, wherein the first safety barrier 122 is separated from the glass panel 106 of the firebox 102 by an offset dimension to define a first interstitial space 132 between the glass panel 106 and the first safety barrier 122; a second transparent safety barrier 134 secured within the housing 112 by upper 136, lower 138 and two opposing side second safety barrier brackets 140, 142, wherein the first safety barrier 122 and the second safety barrier 134 are separated by an offset dimension and define a second interstitial space 144 between the first safety barrier 122 and the second safety barrier 134; at least one inlet opening 146 at a first end 148 of the housing 112 in fluid communication with the second interstitial space 144; at least one exit opening 150 at the first end 148 of the housing 112 in fluid communication with the first interstitial space 132; at least one opening 152 (FIG. 3) at a second end 154 of the housing 112 connecting the first 132 and second 144 interstitial spaces in fluid communication to define a serpentine safety barrier heat exchanger passageway 156 (arrows); and at least one forced air circulating fan or blower 158 secured within the housing 112 and operatively configured to force air through the serpentine safety barrier heat exchanger passageway 156 from the at least one inlet opening 146 to the at least one exit opening 150.

Figure 4:
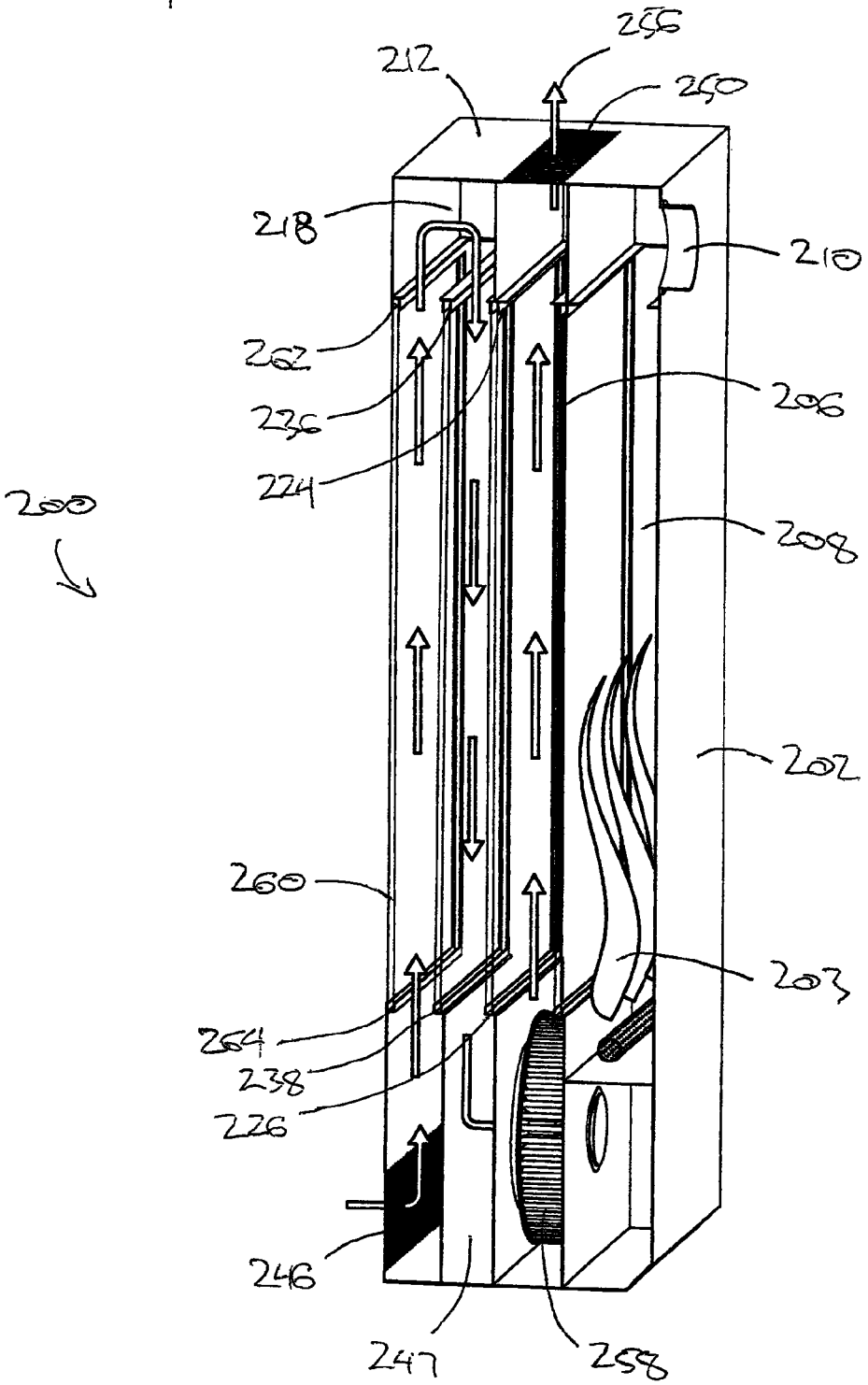
FIG. 4 is a schematic cutaway perspective view of a fireplace comprising a 4-panel fireplace safety barrier heat exchanger in accordance with another embodiment of the presently described subject matter.
Figure 5:
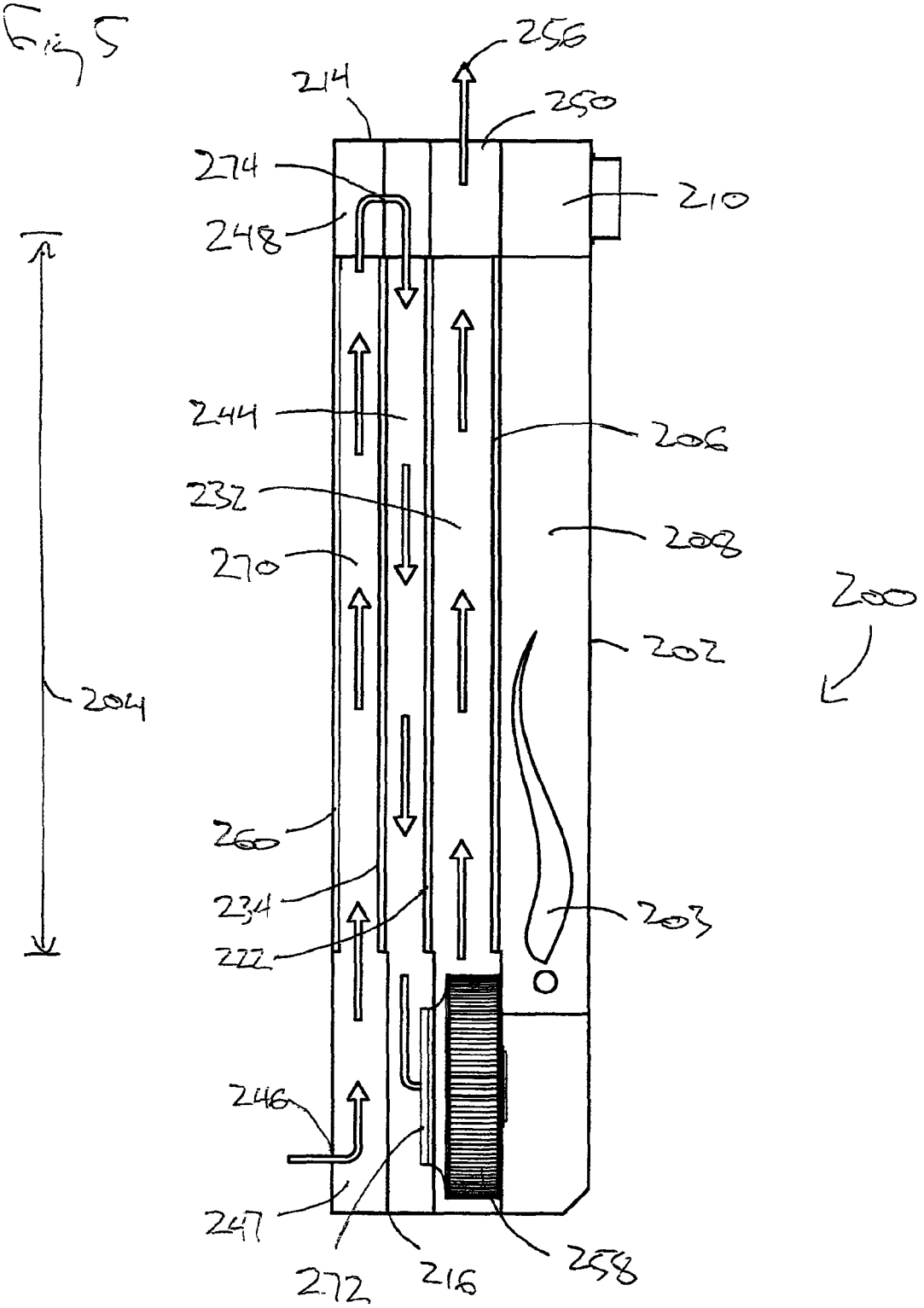
FIG. 5 is a vertical cross sectional side view of the fireplace of FIG. 6.

Referring now to FIGS. 4-5, a fireplace system with safety barrier heat exchanger 200 in accordance with various embodiments of the present disclosure is illustrated. Fireplace system with safety barrier heat exchanger 200 comprises many of the components of fireplace system with safety barrier heat exchanger 100 illustrated and described with reference to FIGS. 1-3; however, fireplace system with safety barrier heat exchanger 200 further comprises a third safety barrier 260. Firebox 202 includes a viewable opening 204; a glass panel 206 disposed across the viewable opening which, in combination with the firebox, forms a combustion chamber 208; at least one opening (not shown) in a lower portion of the firebox 202 for permitting combustion air to pass into the combustion chamber 208, and at least one opening 210 in an upper portion of the firebox 202 for exhausting combustion gases from flame 203 from the combustion chamber 208; and a safety barrier heat exchanger disposed across the glass panel 206 and viewable opening 204 of the firebox 202, the safety barrier heat exchanger comprising: a housing affixed to the firebox, the housing 212 comprising top 214, bottom 216 and two opposite side panels 218, 220 (not shown); a first transparent safety barrier 222 secured within the housing 212 by upper 224, lower 226 and two opposing side first safety barrier brackets 228, 230 (not shown), wherein the first safety barrier 222 is separated from the glass panel 206 of the firebox 202 by an offset dimension to define a first interstitial space 232 between the glass panel 206 and the first safety barrier 222; a second transparent safety barrier 234 secured within the housing 212 by upper 236, lower 238 and two opposing side second safety barrier brackets 240, 242 (not shown), wherein the first safety barrier 222 and the second safety barrier 234 are separated by an offset dimension and define a second interstitial space 244 between the first safety barrier 222 and the second safety barrier 234; a third transparent safety barrier 260 secured within the housing 212 by upper 262, lower 264 and two opposing side third safety barrier brackets 266, 268 (not shown), wherein the second safety barrier 234 and the third safety barrier 260 are separated by an offset dimension and define a third interstitial space 270 between the second safety barrier 234 and the third safety barrier 260; at least one inlet opening 246 at a second end 247 of the housing 212 in fluid communication with the third interstitial space 270; at least one exit opening 250 at a first end 248 of the housing in fluid communication with the first interstitial space 232; at least one opening 272 at the second end 247 of the housing 212 connecting the first 232 and second 244 interstitial spaces in fluid communication, and at least one opening 274 at a first end 248 of the housing 212 connecting the second 244 and third 270 interstitial spaces in fluid communication to define a serpentine safety barrier heat exchanger passageway 256 (arrows); and at least one forced air circulating fan or blower 258 secured within the housing 212 and operatively configured to force air through the serpentine safety barrier heat exchanger passageway 256 from the at least one inlet opening 246 to the at least one exit opening 250.

Figure 6:
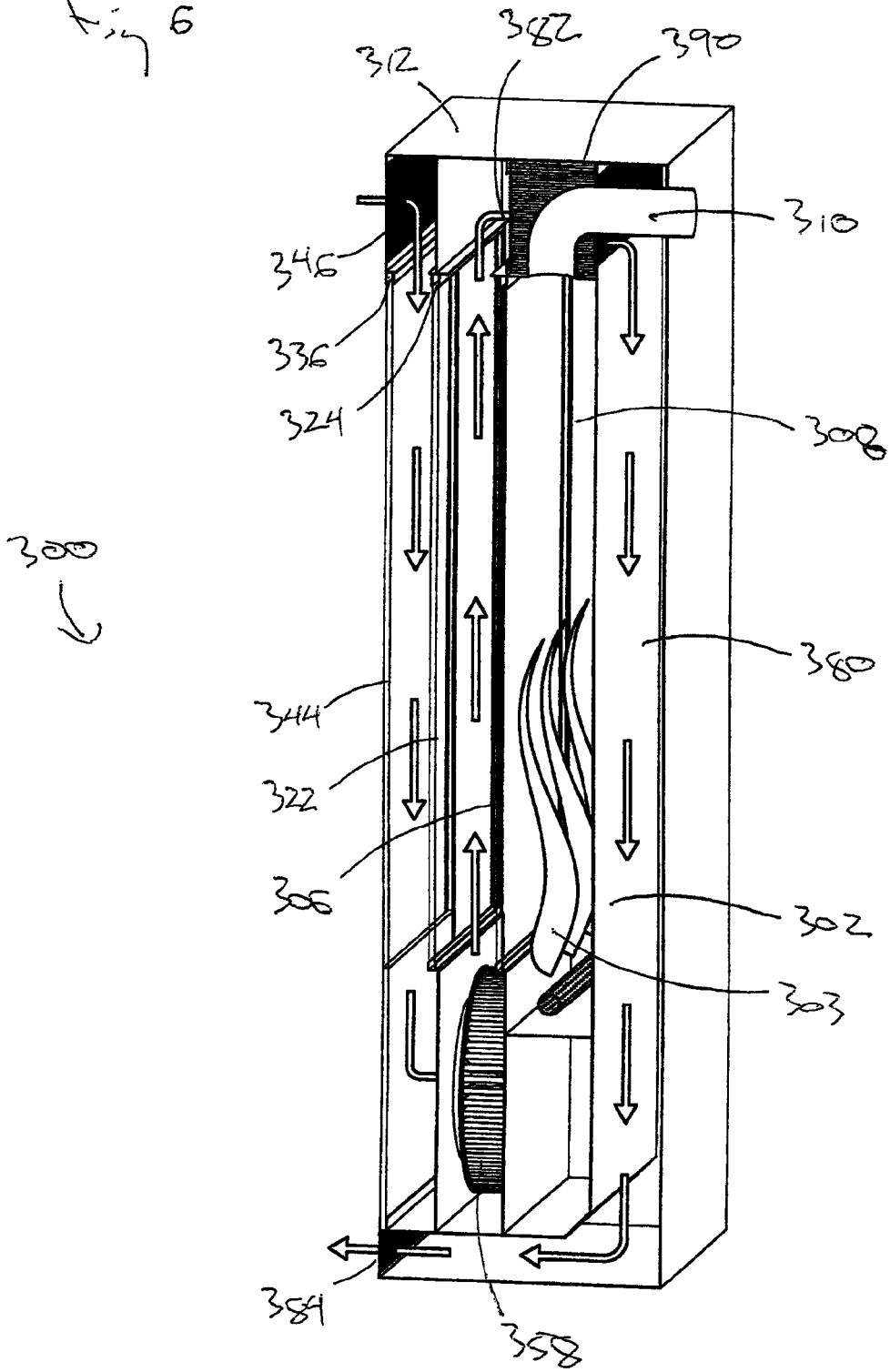
FIG. 6 is a schematic cutaway perspective view of a fireplace comprising a refractory chamber and a 3-panel fireplace safety barrier heat exchanger in accordance with another embodiment of the presently described subject matter.
Figure 7:
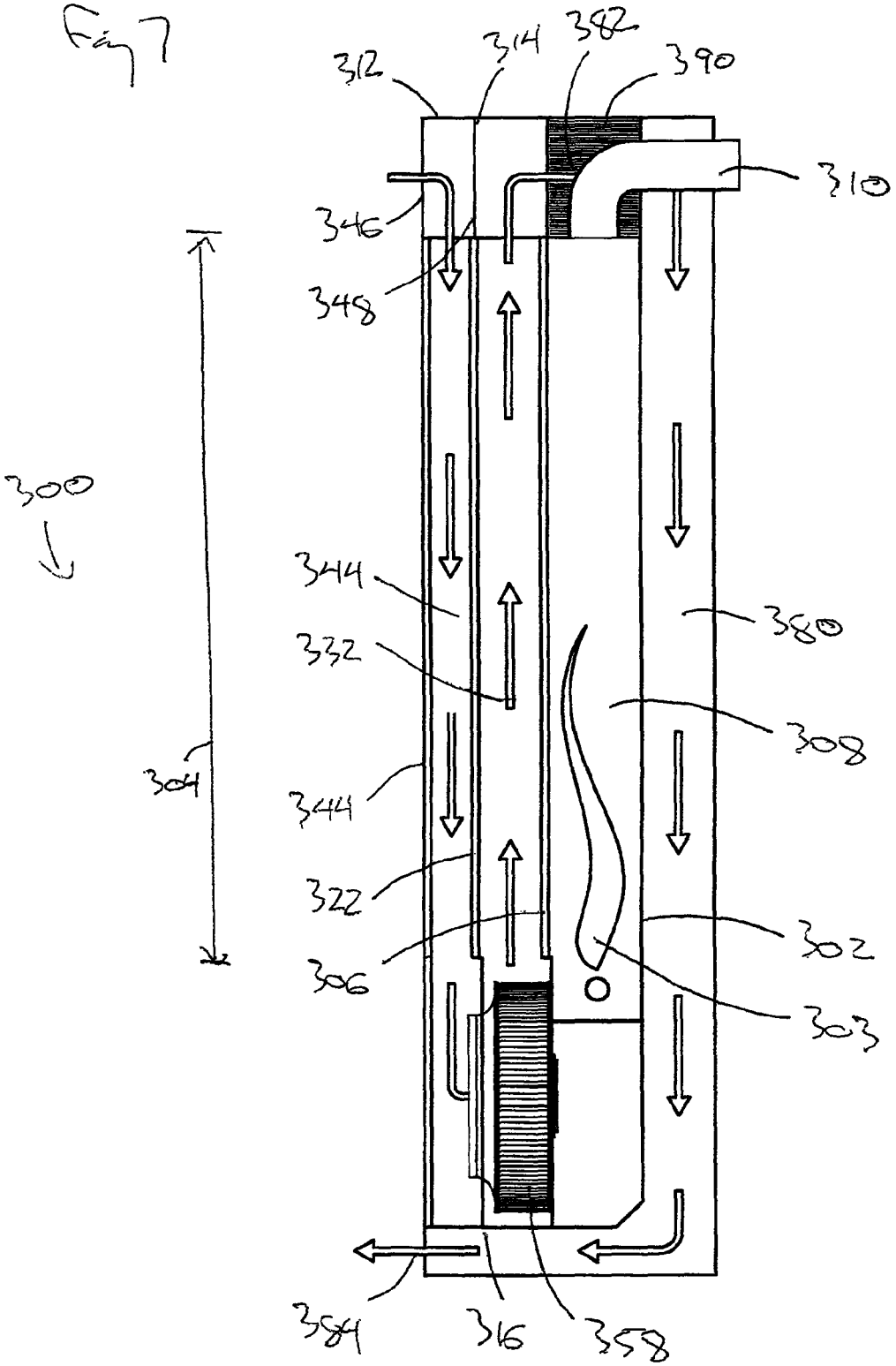
FIG. 7 is a vertical cross sectional side view of the fireplace of FIG. 4.

With reference to FIGS. 6-7, a fireplace system with safety barrier heat exchanger 300 in accordance with various embodiments of the present disclosure is illustrated. Fireplace system with safety barrier heat exchanger 300 comprises many of the components of fireplace system with safety barrier heat exchanger 100 and 200 illustrated and described above; however, fireplace system with safety barrier heat exchanger 300 further comprises a refractory chamber 380 and an optional firebox top heat exchanger 390. Firebox 302 includes a viewable opening 304; a glass panel 306 disposed across the viewable opening which, in combination with the firebox, forms a combustion chamber 308; at least one opening (not shown) in a lower portion of the firebox 302 for permitting combustion air to pass into the combustion chamber 308, and at least one opening 310 in an upper portion of the firebox 302 for exhausting combustion gases from flame 303 from the combustion chamber 308; a refractory chamber 380 surrounding the firebox 302 except across the at least one viewable opening 304, the refractory chamber 380 comprising at least one refractory chamber ambient air inlet 382 and at least one refractory chamber ambient air outlet 384; and a firebox top heat exchanger 390 disposed above the firebox 302 within the refractory chamber 380. A safety barrier heat exchanger is disposed across the glass panel 306 and viewable opening 304 of the firebox 302, the safety barrier heat exchanger comprising: a housing affixed to the firebox, the housing 312 comprising top 314, bottom 316 and two opposite side panels 318, 320; a first transparent safety barrier 322 secured within the housing 312 by upper 324, lower 326 and two opposing side first safety barrier brackets 328, 330, wherein the first safety barrier 322 is separated from the glass panel 306 of the firebox 302 by an offset dimension to define a first interstitial space 332 between the glass panel 306 and the first safety barrier 322; a second transparent safety barrier 334 secured within the housing 312 by upper 336, lower 338 and two opposing side second safety barrier brackets 340, 342, wherein the first safety barrier 322 and the second safety barrier 334 are separated by an offset dimension and define a second interstitial space 344 between the first safety barrier 322 and the second safety barrier 334; at least one inlet opening 346 at a first end 348 of the housing 312 in fluid communication with the second interstitial space 344; at least one exit opening corresponding to the at least one refractory chamber ambient air inlet 382 at a first end 348 of the housing 312 connecting the first interstitial space 332 and the at least one refractory chamber air inlet 382 in fluid communication; at least one opening 352 at a second end 354 of the housing 312 connecting the first 332 and second 344 interstitial spaces in fluid communication to define a serpentine safety barrier heat exchanger passageway 356 (arrows); and at least one forced air circulating fan or blower 358 secured within the housing 312 and operatively configured to force air through the serpentine safety barrier heat exchanger passageway 336 from the at least one inlet opening 346 to the at least one opening 382, then through optional firebox top heat exchanger 390 and through refractory chamber 380, and finally through the at least one refractory chamber ambient air outlet 384.

Figure 8:
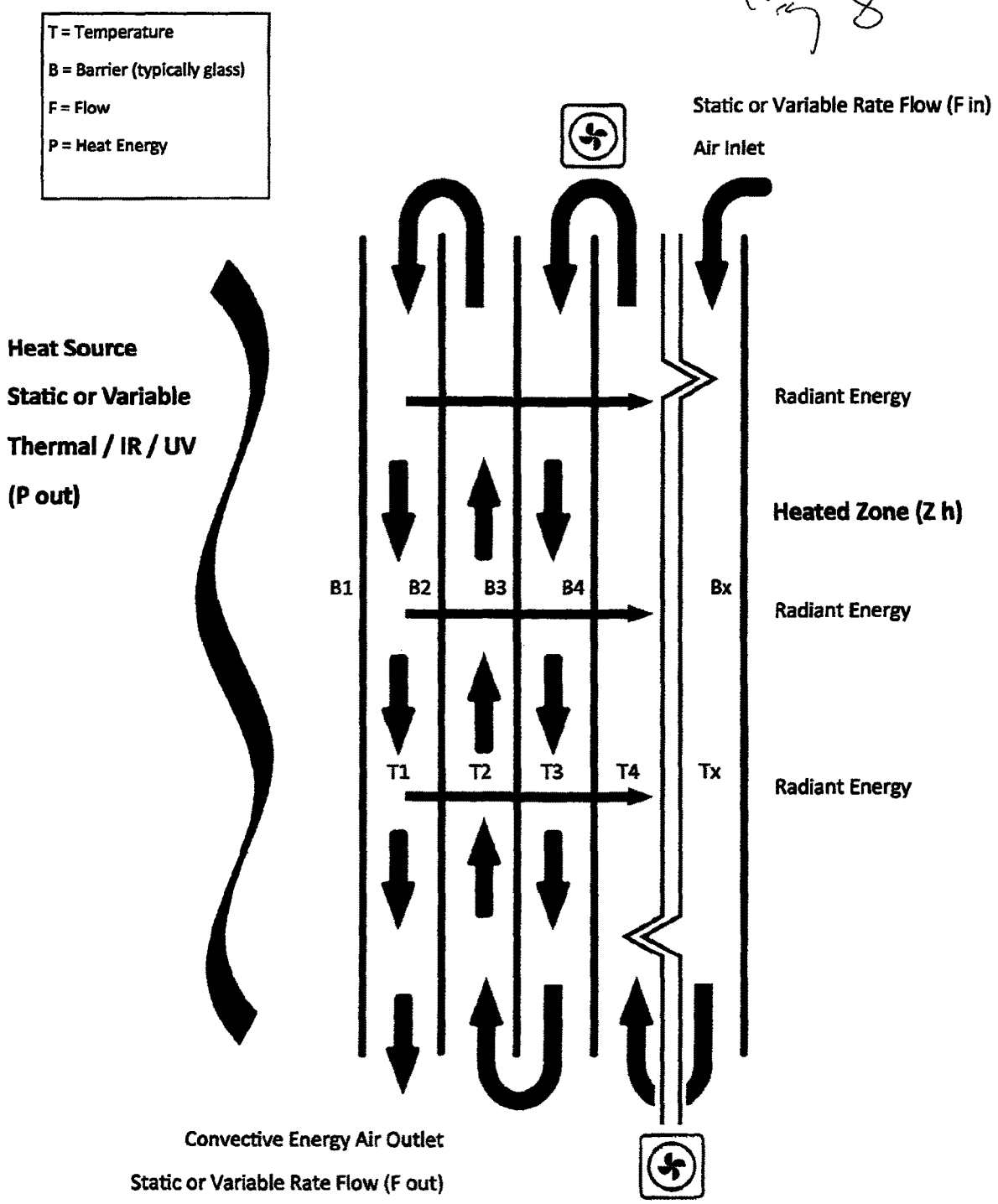
FIG. 8 is a schematic flow diagram of a safety barrier heat exchanger in accordance with embodiments of the presently described subject matter.

FIG. 8 is a schematic flow diagram of a safety barrier heat exchanger in accordance with embodiments of the presently described subject matter. As schematically illustrated, the safety barrier heat exchanger includes an initial optically transparent, semi-transparent or translucent barrier panel "B1" disposed across a viewable opening of a heating appliance such as a fireplace or furnace in which a static or variable heat source "P out" provides thermal, infrared, and/or ultraviolet output; and a plurality of additional optically transparent, semi-transparent or translucent barrier panels "B2" through "Bx", each of panels B1 through Bx being held in spaced apart relationship from one another by selected suitable offset dimensions within a suitable housing to define a plurality of inter-connected interstitial spaces therebetween. As discussed in relation to various embodiments described above, barrier panel B1 may comprise the panel of heat resistant safety glass commonly employed in a modern insert fireplace (to enclose and seal off the fireplace viewable opening to create a combustion chamber in which the combustible fuel may more efficiently be burned), or barrier panel B1 may comprise an optically transparent, semi-transparent or translucent combustion chamber barrier as a component part of the safety barrier heat exchanger. Including barrier panel B1, at least two additional barrier panels (i.e. B2 and B3) are required in order to create a tortuous or serpentine passage passageway through which a forced bulk flow of ambient air may be passed across a viewable opening more than one time, but a virtually unlimited additional number of barrier panels (i.e. B4 to Bx) may be employed in a safety barrier heat exchanger in accordance with embodiments of the presently described subject matter. Situated opposite the final one of the additional barrier panels (i.e. B4 to Bx) employed in any given safety barrier heat exchanger configuration is the heated zone "Zh", which typically comprises a residential room or commercial space in which the heating appliance is situated.

Each of barrier panels B1 through Bx may, for example, comprise conventional 6 mm safety glass, but alternative suitable optically transparent, semi-transparent or translucent materials may be used. The interstitial space or gap between adjacent panels B1 through Bx may, for example, be about 20 to about 35 mm; however, alternate spacing may be employed according to application. The housing (see e.g. 112, 212, 312 of FIGS. 1-7) may be constructed of any suitable heat resistant material such as steel.

As illustrated in FIG. 8, the temperature of each successive barrier panel, and of the air within each interstitial space or gap between adjacent panels, from the innermost (i.e. combustion barrier/first safety barrier) panel B1 to the outermost safety barrier panel Bx is higher than the preceding barrier panel. In other words, T1>T2>T3>Tx.

Radiant energy emanating from the firebox opening (and conductive energy emanating from the combustion barrier) is converted into convection energy in ambient air being circulated through the safety barrier heat exchanger from an inlet "F in" associated with the outermost panel Bx to an outlet "F out" associated with the innermost panel B1 by at least one static or variable rate fan or blower, and is then supplied to the heated zone Zh (i.e. the room in which the heating appliance is situated, and/or another location via conventional ducting). For optimum heat exchange, the flow path through the first interstitial space (between panels B1 and B2) is vertically upwards, but alternate embodiments may involve a horizontal flow path in each interstitial space, a vertical downward flow path, or any combination of vertical and/or horizontal and/or diagonal flow paths.

The location of fans and/or blowers within the safety barrier heat exchanger is determined according to application, and one or more additional fans or blowers may be used to boost air flow to a downstream ducted system. In some embodiments, ideal fan/blower location may be principally be predicated on sound attenuation principles and/or airflow efficiency and/or survivability of the fan/blower. The temperature at the outermost (i.e. "touch") barrier panel Bx and temperature of the heated outlet air is controlled to be within limits set by certification standards, and to suit individual application requirements. In preferred embodiments, variable flow rate controllable fans or blowers may be utilized to maintain outermost barrier Bx temperature below a safe maximum during operation even when the fireplace system is operating at high burner combustion temperatures and serving as a heating appliance.

The diagrammatical representation of the safety barrier heat exchanger in the attached Figures, including the spacing of barrier panels and configuration of brackets within which the barrier panels are held within the safety barrier heat exchanger, should not be interpreted as depicting any particular structural limitation, configuration, or spatial relationship of the various components shown, but instead is merely intended to illustrate various functional aspects of a safety barrier heat exchanger in accordance with various embodiments. The present description is of the best presently contemplated mode of carrying out the subject matter disclosed herein. The description is made for the purpose of illustrating the general principles of the subject matter and not to be taken in a limiting sense; the described subject matter can find utility in a variety of implementations without departing from the scope of the invention made, as will be apparent to those of skill in the art from an understanding of the principles that underlie the invention.

The invention claimed is:

1. A fireplace assembly comprising:

a firebox including a viewable opening, at least one opening in a lower portion of the firebox for combustion air and at least one opening in an upper portion of the firebox for exhausting combustion gases;

a firebox glass or optically transparent, semi-transparent or translucent panel disposed across the viewable opening;

a housing which is hermetically affixed to the firebox, the housing including a top, which includes an outlet opening, which is adjacent to the firebox, a bottom, a pair of side panels therebetween, a front and an inlet opening, the inlet opening and the outlet opening in fluid communication with an ambient environment;

at least two glass or optically transparent, semi-transparent or translucent panels which are retained in the housing, an inner panel disposed across the firebox glass and an outer panel disposed across the inner panel, wherein the two panels, with the firebox glass, define a single serpentine passageway extending between and in fluid communication with the inlet opening and the outlet opening; and at least one forced air circulating fan or blower secured to the housing and operatively configured to urge an airflow through the serpentine passageway from the at least one inlet opening to the at least one outlet opening such that adjacent airflows are counter-current to one another.

2. The fireplace assembly of claim 1, wherein there are two glass or optically transparent, semi-transparent or translucent panels, and the inlet opening enters into a channel between the inner panel and the outer panel proximate to the top of the housing or in the top of the housing.

3. The fireplace assembly of claim 1, further comprising a middle panel, the middle panel disposed between the inner panel and the outer panel, and the inlet opening enters into a channel between the middle panel and the outer panel proximate to the bottom of the housing or in the bottom of the housing.

4. The fireplace assembly of claim 1, wherein there are n odd number of glass or optically transparent, semi-transparent or translucent panels, and the inlet opening enters into a channel between an nth panel and the nth−1 panel, proximate to the bottom of the housing or in the bottom of the housing.

5. The fireplace assembly of claim 1, wherein there are n even number of glass or optically transparent, semi-transparent or translucent panels and the inlet opening enters into a channel between an nth panel and the nth−1 panel proximate to the top of the housing or in the top of the housing.

6. The fireplace assembly of claim 5, wherein the fan or blower is retained on the front of the housing proximate to the bottom.

7. A method of exchanging heat in a single flow of air, the method comprising: selecting the fireplace assembly of claim 1; combusting a material in the firebox; drawing air from an ambient environment into the single serpentine passageway; and urging the single flow of gas through the single serpentine passageway and out into the ambient environment.

8. A combined safety barrier-heat exchanger for a heating appliance, the combined safety barrier-heat exchanger comprising:

a housing for attachment to a firebox, the housing including a top, which includes an outlet opening, a bottom, a pair of side panels therebetween, a front and an inlet opening, the inlet opening and the outlet opening in fluid communication with an ambient environment;

at least three glass or optically transparent, semi-transparent or translucent panels which are retained in the housing, an inner panel, a middle panel and an outer panel wherein the middle panel is disposed between the inner panel and the outer panel, and the inlet opening enters into a channel between the middle panel and the outer panel proximate to the bottom of the housing or in the bottom of the housing wherein the panels define a single serpentine passageway extending between and in fluid communication with the inlet opening and the outlet opening; and at least one forced air circulating fan or blower secured to the housing and operatively configured to urge an airflow through the serpentine passageway from the at least one inlet opening to the at least one outlet opening such that adjacent airflows are counter-current to one another.

9. The combined safety barrier-heat exchanger of claim 8, wherein there are n odd number of glass or optically transparent, semi-transparent or translucent panels, and the inlet opening enters into a channel between an nth panel and the nth−1 panel, proximate to the bottom of the housing or in the bottom of the housing.

10. The combined safety barrier-heat exchanger of claim 8, wherein there are n even number of glass or optically transparent, semi-transparent or translucent panels and the inlet opening enters into a channel between an nth panel and the nth−1 panel proximate to the top of the housing or in the top of the housing.

11. The combined safety barrier-heat exchanger of claim 10, wherein the fan or blower is retained on the front of the housing proximate to the bottom.

12. A method of exchanging heat in a single flow of air, the method comprising selecting the combined safety barrier-heat exchanger of claim 8; affixing the housing to a firebox; combusting a material in the firebox; drawing air from an ambient environment into the single serpentine passageway; and urging the single flow of gas through the single serpentine passageway and out into the ambient environment.

* * * * *